United States Patent [19]

Schaab et al.

[11] 4,244,198

[45] Jan. 13, 1981

[54] SLIVER LOOP KNIT FABRIC

[76] Inventors: Rudolph S. Schaab, Rte. 2, Lakeview Rd., Caryville, Tenn. 37714; John C. Harralson, 7501 S. Whispering Oak, Powell, Tenn. 37849

[21] Appl. No.: 908,162

[22] Filed: May 22, 1978

Related U.S. Application Data

[63] Continuation-in-part of Ser. No. 788,733, Apr. 19, 1977, abandoned.

[51] Int. Cl.[3] ..... D04B 9/14; D04B 9/16

[52] U.S. Cl. ..... 66/191; 66/194

[58] Field of Search ..... 66/194, 191

[56] References Cited

U.S. PATENT DOCUMENTS

| | | | |
|---|---|---|---|
| 1,831,964 | 11/1931 | Lombardi | 66/191 X |
| 2,280,536 | 4/1942 | Moore | 66/191 |
| 2,712,225 | 7/1955 | Moore | 66/9 B |
| 2,725,735 | 12/1955 | Moore | 66/80 |
| 2,805,564 | 9/1957 | Moore | 66/194 |
| 2,953,912 | 9/1960 | Hill | 66/9 B |
| 3,021,698 | 2/1962 | Hill | 66/9 B |
| 3,083,439 | 4/1963 | Seligson | 66/191 X |
| 3,226,952 | 1/1966 | Cassady | 66/191 X |
| 3,590,604 | 7/1971 | Beucus et al. | 66/194 X |
| 3,710,597 | 1/1973 | Schmidt | 66/191 |
| 3,886,767 | 6/1975 | Dargie | 66/194 X |

FOREIGN PATENT DOCUMENTS

| | | | |
|---|---|---|---|
| 1259055 | 3/1961 | France | 66/191 |
| 809712 | 3/1959 | United Kingdom | 66/191 |

*Primary Examiner*—Wm. Carter Reynolds
*Attorney, Agent, or Firm*—Frailey & Ratner

[57] ABSTRACT

A sliver loop knit fabric comprising a base fabric formed of knitted courses and wales and anchoring a plurality of tufts of sliver fibers, the free ends of which are incorporated into at least two courses and two wales of the fabric to provide a generally loop pile fabric. The fabric is knit on a circular jersey fabric knitter equipped with a plurality of fiber feeding cards. The knitter also is equipped with pneumatic means for directing jets of compressed air generally radially outward of the needles of the knitting machine. The jets of compressed air blow the free ends of the tufts of sliver fibers on the needles outwardly of the needle circle, and onto the tops of the sinkers, preparatory to incorporating the ends of the tufts into the fabric during knitting. The bulk of the free ends are incorporated into the fabric in the form of knitted stitches. Stray ends or "tailings" of the tufts are pushed back between the needles, inwardly of the needle circle by reciprocal sinkers, whereby those ends are interlaced about the needles preparatory to their interlacement in the form of floats into plural courses and wales of the fabric.

3 Claims, 15 Drawing Figures

SLIVER LOOP KNIT FABRIC

RELATED APPLICATION

This application is a continuation-in-part of United States patent application Ser. No. 788,733 filed Apr. 19, 1977, entitled "Method and Apparatus for Knitting Sliver Loop Knit Fabric, and the Resulting Product", now abandoned.

DEFINITIONS

The following definitions shall be applicable herein:

The terms "sliver feeding device" and "card" are synonymous, and indicate the conventional means for feeding a sliver or roving to the needles of a high pile fabric knitting machine.

The term "feeding station" indicates a single location on a knitting machine where sliver fibers and yarn are, or may be, fed in succession to the needles of the machine. The term "feeding station" shall be applicable to indicate such a location where sliver fibers only, without yarn, are fed to the needles of the machine, as in knitting pattern work.

The terms "stitch" and "knitted stitch" are synonymous, and indicate a loop of yarn which has been pulled through a preceding yarn loop.

The term "casting off" indicates the discharge of a loop of yarn from a needle, as a newly drawn loop of yarn is pulled through the discharged loop to form a new stitch.

The term "cast-off level" indicates the lowest level to which a needle descends in casting off a stitch or yarn loop.

The terms "clearing level" and "clear" indicate the level to which a needle rises, or has risen, to clear yarn from its latch, preparatory to receiving a new yarn in its hook.

The terms "course-wise" and "course-wise extending" are directional terms indicating the "horizontal" dimension extending along a course of a knitted fabric.

The terms "wale-wise" and "wale-wise extending" are directional terms indicating the "vertical" dimension extending along a wale of a knitted fabric.

The term "interlaced" refers to sliver fibers which are not incorporated into the fabric in the form of knitted stitches, but rather have been incorporated into the fabric in the form of floats extending diagonally across at least two courses and two wales of the fabric. The interlaced fibers are manipulated between and about the needles during knitting in such manner that, when the needles descend to cast-off level, those fibers are cast over the needles and are incorporated into the fabric as floats.

BACKGROUND OF THE INVENTION

Sliver knitting, wherein sliver fibers and yarn are fed to the needles of a knitting machine to knit pile fabric, is an old art, tracing its origin back to U.S. Pat. No. 1,114,414. The knitting mechanism usually comprises a circular jersey fabric knitter equipped with a plurality of cards for feeding sliver fibers to the needles of the knitting mechanism. Generally, in sliver knitting, a single-faced high pile fabric is produced, comprising a base fabric anchoring tufts of sliver fibers, the free ends of which project from one side of the fabric. Each tuft is of generally U-shaped configuration and is composed of a plurality of staple fibers interlooped with the stitches of the fabric. Such a fabric is illustrated, for example, in U.S. Pat. No. 3,226,952, which utilizes air nozzles located externally of the needle circle to blow the free ends of the tufts under the sinker nibs, to position the tufts selectively on the needles during knitting.

Since the inception of sliver knitting, numerous attempts have been made, with little or no commercial success, to produce sliver knit fabrics which depart from the single-faced high pile type. Two-faced pile fabrics have been proposed, as illustrated in U.S. Pat. Nos. 2,712,225, 2,725,735, 2,953,912 and 3,021,698. In U.S. Pat. No. 2,953,912, successive, oppositely disposed air jets are utilized to produce a two-faced high pile fabric. The oppositely disposed air jets are mounted adjacent alternating cards spaced around the needle circle.

Attempts have been made to produce sliver loop knit fabrics in the past utilizing conventional sliver knitters. Such attempts are illustrated by U.S. Pat. Nos. 2,255,078, 2,280,536 and 2,457,104. So far as presently is known, such endeavors have not proved to be successful in practice. In U.S. Pat. Nos. 2,255,078 and 2,280,536, angularly spaced rotary brushes, disposed to engage the needles, are proposed to brush the free ends of sliver fibers held by the needles first outwardly and then inwardly between the needles, to produce a two-faced sliver knit fabric. In U.S. Pat. No. 2,457,104 suction means, disposed adjacent the needles, is utilized to draw the free ends of sliver fibers held by the needle outwardly of the needle circle, whereby the free ends of the pile fibers project from what normally is the rear plain face of the fabric.

SUMMARY OF THE INVENTION

The primary object of this invention is to provide a new and improved apparatus and method for knitting sliver loop knit fabric.

A further object of the invention is to provide a new and improved sliver knitter for forming sliver fibers and yarn into knitted fabric, wherein novel fiber manipulating means are provided for incorporating tufts of sliver fibers into plural stitches during knitting, to provide a generally loop pile fabric.

A further object is to provide a sliver knitter of the type described, wherein the fiber manipulating means includes pneumatic means for blowing the free ends of tufts of sliver fibers outwardly relative to the knitting needles onto the tops of the sinkers, preparatory to being knitted into the fabric, and reciprocable sinkers adapted to be advanced to push stray fiber ends inwardly relative to the needles, whereby the stray ends of the tufts of sliver fibers are interlaced around the needles during knitting.

A further object is to provide a new and improved method of making sliver loop knit fabric on a sliver high pile fabric knitting machine wherein compressed air means are utilized to blow the free ends of tufts of sliver fibers outwardly of the needles onto the tops of the sinkers, preparatory to incorporating free ends of the fibers into knitted stitches in the fabric, and sinkers are utilized to push the ends of stray fibers inwardly of the needles, below the needle latches, to interlace the free ends of the tufts of sliver fibers around the needles.

A further object is to provide a novel sliver loop knit fabric comprising a base fabric formed of knitted courses and knitted wales and a plurality of tufts of sliver fibers, each tuft being incorporated into plural courses and plural wales of the base fabric, portions of the tufts being knitted into the base fabric to form knitted stitches and other portions of the tufts being interlaced into the fabric, to provide a fabric having a loop pile effect or texture on one side thereof.

To achieve the foregoing objectives, a sliver high pile fabric circular knitting machine is utilized, of the basic type illustrated in U.S. Pat. No. 1,114,414. The machine comprises a jersey fabric knitter provided with a plurality of angularly spaced sliver and yarn feeding stations. Disposed between successive or adjacent feeding stations are one or more air jets, each air jet being disposed internally of the needle circle and being adapted to direct a stream of compressed air in the direction of the needles.

As the needles ascend from cast-off level, the compressed air jets blow the free ends of the tufts of sliver fibers held on the needles, as well as the free ends of the tufts anchored by one or more adjacent cast-off stitches, outwardly of the needle circle, between the needles, onto the tops of the sinkers surrounding the needles. The several tufts are blown so their free ends are mingled together to form a sheet or web of fibers extending diagonally outward relative to both the sinkers and the needle latches. As the needles continue their ascent to clearing level, their open latches engage and retain most of the outwardly extending fibers. When the needles subsequently descend to cast-off level, their latches are closed to trap under the needle hooks the outwardly extending fibers retained on the latches, preparatory to forming the trapped fibers into knitted stitches.

During the ascent of the needles to clearing level, the usual reciprocable sinkers have been advanced fully to web holding position. When the sinkers advance, they push the outwardly extending mass of fibers, including the stray sliver fibers not trapped by the needle latches, inwardly of the needle circle. The sinkers interlace the free ends of the stray fibers around the needles, below their latches. When the needles descend to cast-off level, the stray sliver fibers are interlaced into the fabric in the form of floats. The above described knitting and interlacing of the free ends of the sliver fibers incorporates the fibers into plural courses and plural wales of the fabric, to provide a sliver loop knit fabric generally similar to loop pile fabric.

Other objects and advantages of this invention will be readily apparent from the following description of preferred embodiments thereof, reference being had to the accompanying drawing.

DETAILED DESCRIPTION OF THE INVENTION

Figure 1:
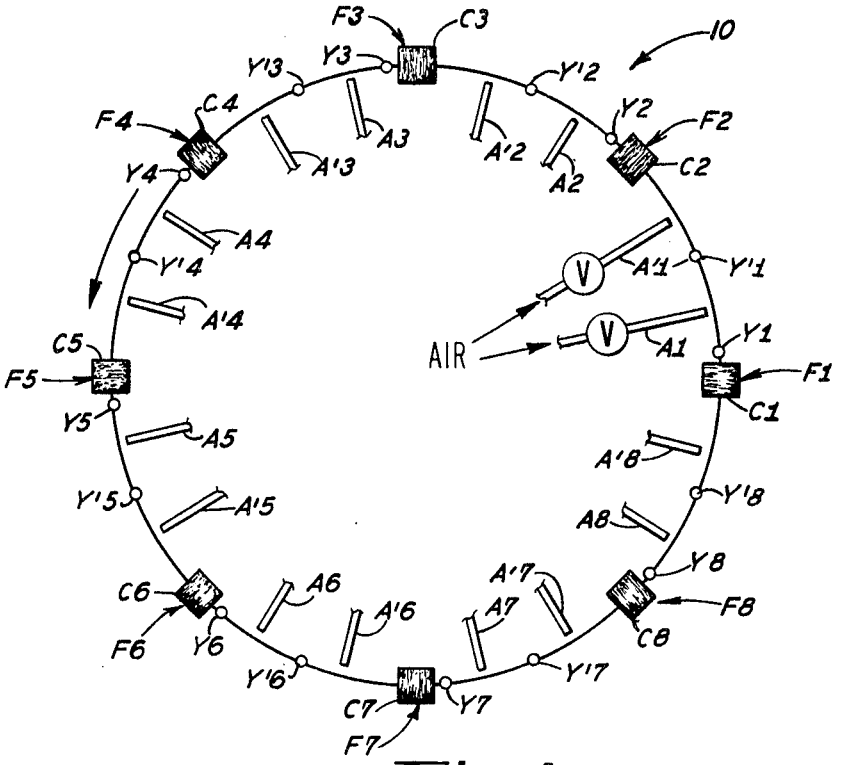
FIG. 1 is a diagrammatic view in top plan showing the knitting head of a multi-feed sliver high pile fabric circular knitting machine embodying this invention.

In FIG. 1, there is shown diagrammatically in top plan the knitting head of an open top multi-feed sliver high pile fabric circular knitting machine 10 to which this invention has been applied. Although the machine 10 may be equipped with four, eight, twelve or fourteen sliver and yarn feeding stations, for the purpose of illustration the machine is shown provided with eight feeding stations, F1 to F8 inclusive, spaced uniformly about the circle of needles. The needles are of the conventional independent latch type, mounted in the usual rotatable needle cylinder. The needle cylinder and its complement of needles rotate in the direction indicated by the curved arrow in FIG. 1.

Each of the eight circumferentially or angularly spaced feeding stations F1–F8 includes, respectively, a conventional card C1, C2, etc., and yarn feed Y1, Y2, etc. A second yarn feed Y'1, Y'2, etc., may be disposed intermediate adjacent or successive sliver and yarn feeding stations. Each yarn feed Y1, Y'1, Y2, Y'2, etc. comprises a yarn tube disposed adjacent to the needle circle, for delivering yarn to the needles.

In the embodiment illustrated diagrammatically in FIG. 1, a pair of angularly spaced air jets or compressed air nozzles A1, A'1, A2, A'2, etc., are disposed between adjacent feeding stations F1, F2, etc. The several air jets are located inside the needle circle, and positioned to direct streams of compressed air outwardly of the needle circle, in the direction of the needles. The air jets may be provided with valves V to adjust and control the amount of compressed air discharged from their nozzles, selectively as desired, during knitting.

Each of the first air jets A1, A2, etc., is spaced angularly, in the direction of needles rotation, from a yarn feed Y1, Y2, etc. Similarly, each of the second air jets A'1, A'2, etc., is spaced angularly, in the direction of needle rotation, from one of the intermediate yarn feeds Y'1, Y'2, etc. The air jets A1, A'1, etc. are disposed adjacent the needle circle at positions proximate to and trailing locations where the needles reach cast-off level.

Figure 2:
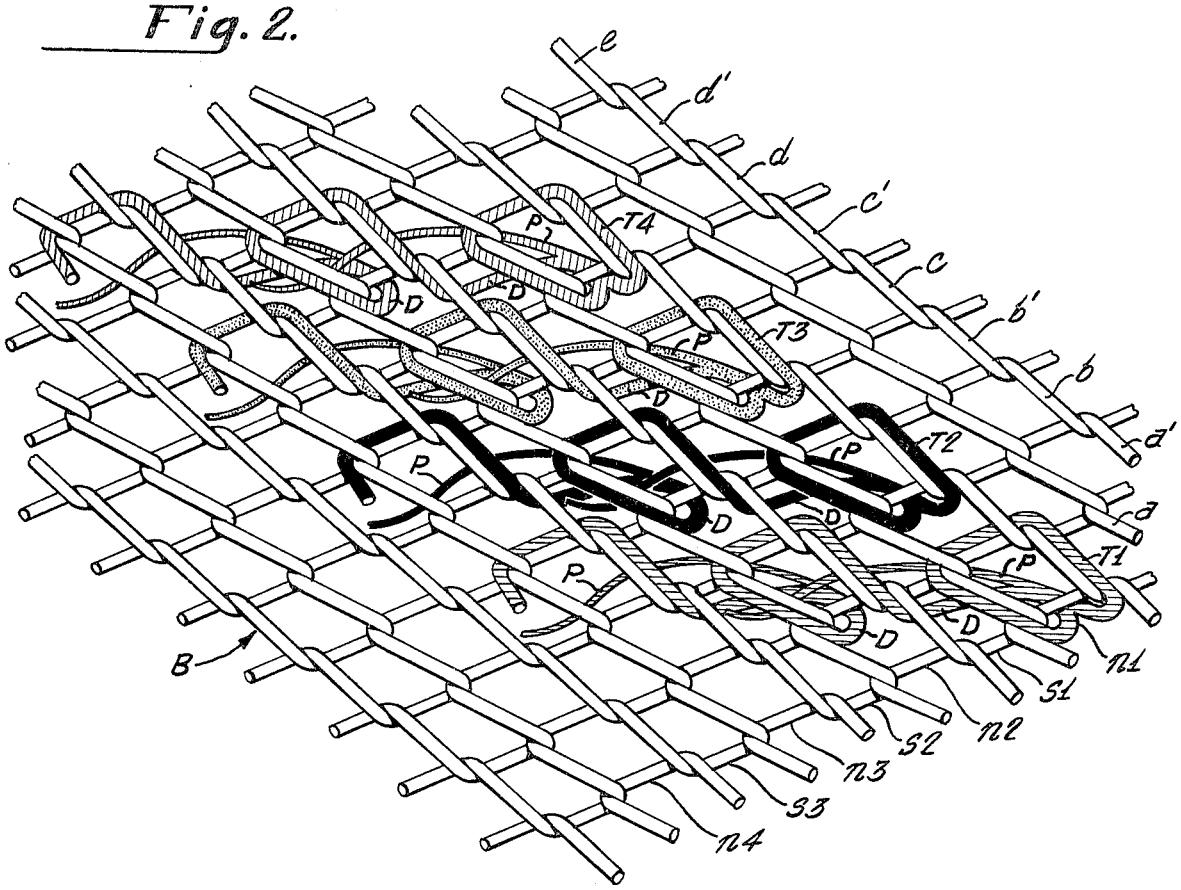
FIG. 2 is a fragmentary, diagrammatic view in perspective showing the outside of a sliver loop knit fabric embodying this invention.
Figure 3:
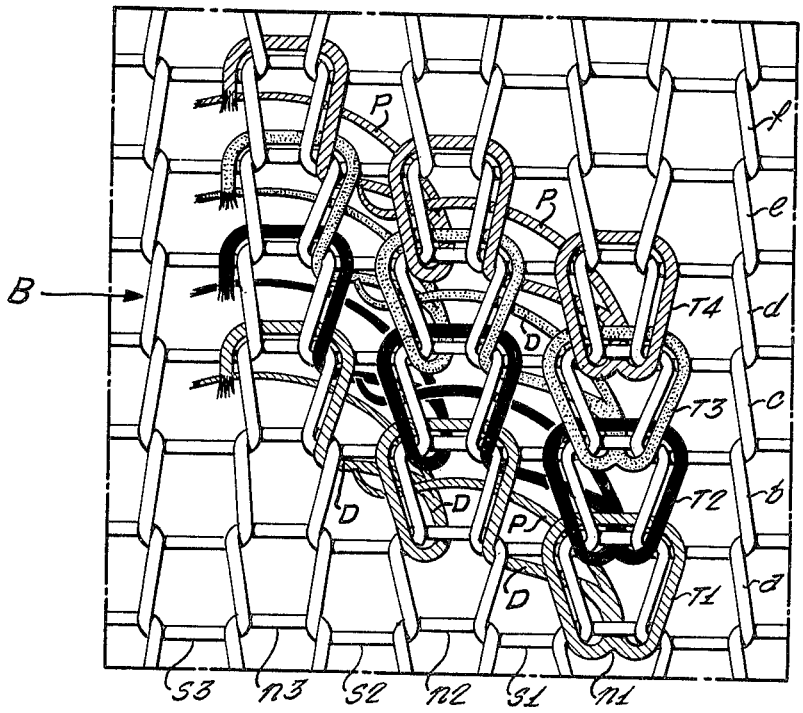
FIG. 3 is a fragmentary, diagrammatic view in perspective showing an alternate form of sliver loop knit fabric embodying this invention.

FIGS. 2 and 3 each illustrate diagrammatically the outside or backside of two different sliver loop knit fabrics made on a knitting machine embodying this invention. Both are jersey knit fabrics having a plurality of tufts T1, T2, T3, T4 of sliver fibers, the free ends of which are incorporated into a plurality of courses and wales, to provide a fabric generally similar to loop pile fabric. In FIGS. 2 and 3, the letters a, a', b, b', c, etc., indicate courses, the letters n1, n2, n3, n4 indicate needle wales and the letters s1, s2, s3, s4 indicate sinker wales of the fabrics. The tufts T1, T2, T3, T4 are incorporated into the fabrics both in the form of knitted stitches and by interlacing. The fabrics have a loop pile effect on the side comprising the inner surface of the fabric tube during knitting, and have the appearance of a jersey knitted web on the opposite side. The loop pile effect appears on the side of the fabric which constitutes the pile face or pile side of a conventional single-faced sliver knit high pile fabric.

FIG. 2 illustrates a fabric knit on the machine 10 of FIG. 1 by feeding sliver fibers and yarn to the needles at all the feeding stations F1, F2, etc., and feeding yarn to the needles at the intermediate yarn feeds Y'1, Y'2, etc. For the purpose of illustration only, in relating the fabric illustrated in FIG. 2 to the machine illustrated in FIG. 1, the following yarn feeds of the machine correspond to the following courses of the fabric:

| Yarn Feed | Yarn Course |
|---|---|
| Y1 | a |
| Y'1 | a' |
| Y2 | b |
| Y'2 | b' |
| Y3 | c |
| Y'3 | c' |
| Y4 | d |
| Y'4 | d' |
| Y5 | e |
| etc. | etc. |

The correlation between the knit-in sliver tufts T1, T2, T3, T4 of the fabric of FIG. 2 and the cards or sliver feeding devices of the machine of FIG. 1, for the purpose of illustration, is as follows:

| Fed by Card | Sliver Tuft |
|---|---|
| C1 | T1 |
| C2 | T2 |
| C3 | T3 |
| C4 | T4 |

The sequence of sliver feeding then may be repeated, as follows:

| Fed by Card | Sliver Tuft |
|---|---|
| C5 | T1 |
| C6 | T2 |
| C7 | T3 |

-continued

| Fed by Card | Sliver Tuft |
|---|---|
| C8 | T4 |

In FIG. 2, each of the groups or tufts of plural staple fibers T1, T2, T3, T4 are shown as being knitted, i.e. incorporated in the form of knitted stitches, in needle wales n1, n2 and n3, and are shown traversing sinker wales s1 and s2, with their extreme ends terminating in sinker wale s3. Successive knitted stitches formed from each of the tufts T1, T2, T3, T4 are connected between adjacent courses by diagonal segments D of sliver fibers. Segments D traverse diagonally the sinker wales, extending from the base of one of the successive stitches to the base of the next following of the successive stitches. Additionally, a portion P of each tuft T1, T2, T3, T4 is illustrated in needle wales n1, n2 as splitting off from the diagonal segments D of the knitted fibers and being interlaced into the fabric. The sliver tuft T1 is shown incorporated into three separate courses, viz. a, a', b. Similarly, sliver T2 is shown incorporated into courses b, b', c; sliver T3 in courses c, c', d; sliver T4 in courses d, d', e. For the purpose of illustration, the several groups of sliver fibers T1, T2, T3, T4 are shown as having been fed by their respective cards only to the single needle forming needle wale n1. It is to be understood that the same slivers are fed to successive needles forming the successive needle wales n2, n3, n4, etc., to form course-wise and wale-wise repeats of the several knit slivers T1, T2, T3, T4.

The interlaced portions P are in the nature of elongated floats extending across at least two courses and at least two wales of the fabric. Thus, float P of tuft T1 extends from the base of the stitch of T1 fibers knitted in needle wale n1 across sinker wale s1 and needle wale n2 to sinker wale s2, where at least some of its fibers, if of sufficient length, merge into the knitted stitch formed with fibers of tuft T1 in course b at needle wale n3. In course a' at needle wale n2, float P of tuft T1 is locked into the fabric between the base fabric B and the diagonal segment D formed of the fibers of tuft T1. Floats P of tufts T2, T3 and T4 similarly extend across and are locked into the fabric. The floats P passing and trapped between the base fabric B and the diagonal segments D connecting the stitches knitted of the tufts T1, T2, T3, T4 tend to raise those segments from the base fabric to emphasize the loop pile effect. However, due to the random disposition of the floats P throughout the fabric, the floats may be locked into the fabric, against the base fabric B, by succeeding floats P as well as by the diagonal segments D. The relatively short diagonal segments D and the relatively long interlaced floats P constitute the loops of fibers providing the loop pile texture on what normally is the face side of a conventional sliver knit high pile fabric.

If desired, the fibers of selected tufts may have a characteristic differing from the characteristics of the fibers of the other tufts. For example, the fibers which compose the pile tufts T1, T2, T3, T4 may each be of a different or contrasting color, to provide a multi-colored or multi-hued sliver loop knit fabric. Where slivers of different colors are fed to the needles by the cards C1, C2, C3, C4, etc., the fabric will incorporate a plurality of groups of tufts, with each group being composed of staple fibers having a color differing from or contrasting with the colors of the fibers of the other groups of tufts. Of course, the separate sliver fibers may differ in characteristics other than or in addition to color, to provide a wide range of patterned fabrics of selected or predetermined design.

The fabric of FIG. 3 differs from that of FIG. 2 only in that the intermediate courses a', b', c', etc., are eliminated. This is accomplished by eliminating or blanking out the intermediate yarn feeds Y'1, Y'2, Y'3, etc., of the knitting machine 10 of FIG. 1. For the purpose of illustration only, the correlation between the yarn feeds and cards of the machine 10 of FIG. 1 and the courses and tufts of sliver fibers of the fabric of FIG. 3 may be as follows:

| Yarn Feed | Course |
|---|---|
| Y1 | a |
| Y2 | b |
| Y3 | c |
| Y4 | d |
| Y5 | e |
| etc. | etc. |

| Fed by Card | Sliver Tuft |
|---|---|
| C1 | T1 |
| C2 | T2 |
| C3 | T3 |
| C4 | T4 |
| C5 | T1 |
| C6 | T2 |
| C7 | T3 |
| C8 | T4 |

As is clearly illustrated by FIGS. 2 and 3, regardless whether the intermediate yarn feeds Y'1, Y'2, Y'3, etc., are utilized, the fabrics of this invention incorporate sliver fibers in the form of knitted stitches, diagonal segments D and interlaced floats P in all of their courses and wales.

Referring next to FIGS. 4, 5*a*, 5*b*, 6, there is illustrated schematically a modified open top multi-feed sliver high pile fabric circular knitting machine 10' for knitting the loop knit fabric of FIG. 2. The modified knitting machine 10' is identical to the machine 10 illustrated in FIG. 1, except it is provided with four feeding stations rather than eight. Two of the four feeding stations are indicated at F'1, F'2 in FIG. 4. Feeding station F'1 includes the usual wire-covered rotatable doffer 12 for feeding staple sliver fibers to the needles N of the machine 10', and the usual yarn tube 14 for feeding a yarn a to the needles. Feeding station F'2 includes rotatable doffer 13 together with a yarn tube (not shown).

Disposed intermediate the spaced feeding stations F'1, F'2 is a second yarn tube 15, for feeding a yarn a' to the needles N, and a pair of angularly spaced compressed air jets A1', A'1'. The two air jets A1', A'1' are disposed adjacent the needle circle, with their open ends or orfices oriented to direct a stream of compressed air in the direction of the needles. The reciprocable needles N are mounted in the usual needle cylinder 18 (FIG. 6), and alternate with the usual reciprocable sinkers S supported by sinker ring 19.

Figure 6:
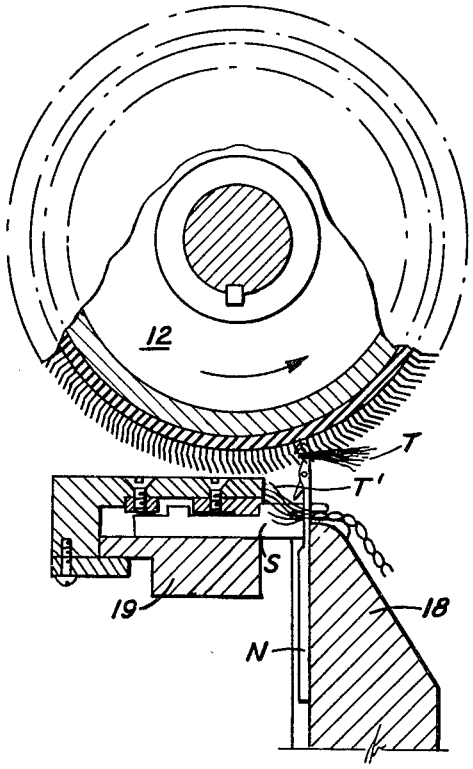
FIG. 6 is a fragmentary vertical section taken transversely of one of the sliver feeding devices of the machine of FIG. 4, illustrating the feeding of sliver fibers by a doffer to the needles of the machine.

FIG. 6 illustrates a needle N which previously had been raised to clear level, and is in the process of receiving a tuft T of sliver fibers in its hook. Knitted tuft T', fed to the needle N at the preceding feeding station, has cleared the needle latch. Due to the rotation of the doffer 12, its wire clothing brushes the free ends of the fibers of the tuft T inward relative to the needle circle, whereby the tuft initially is disposed in a more or less U-shaped configuration about the needle. The sinkers S are in advanced position relative to the circle of needles N.

Figure 5A:
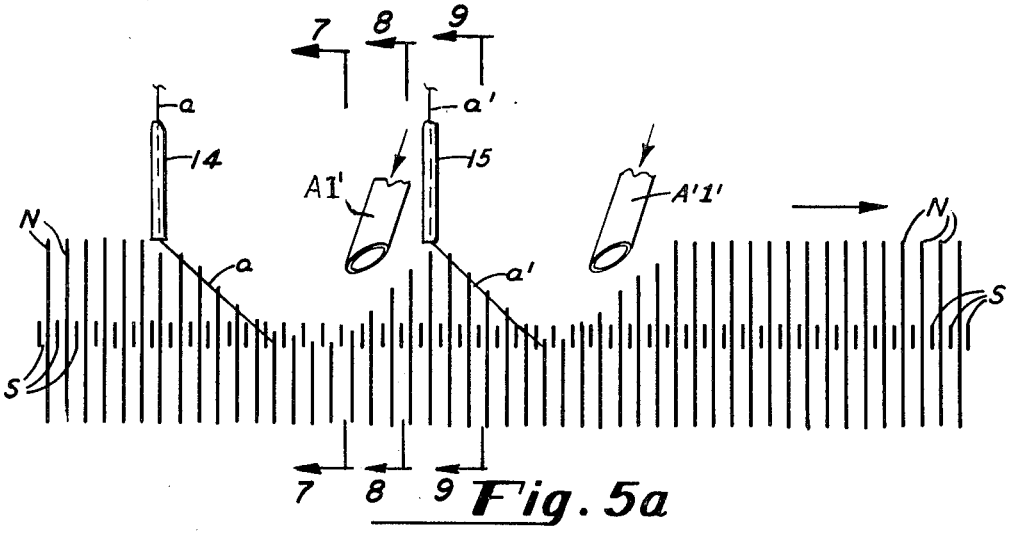
FIG. 5*a* is an enlarged, fragmentary, diagrammatic view in linear development, taken externally of the needle cylinder of the machine of FIG. 4, showing in elevation the needles, sinkers, yarns, yarn tubes and air jets in their relationship to each other, for knitting the fabric of FIG. 2.
Figure 5B:
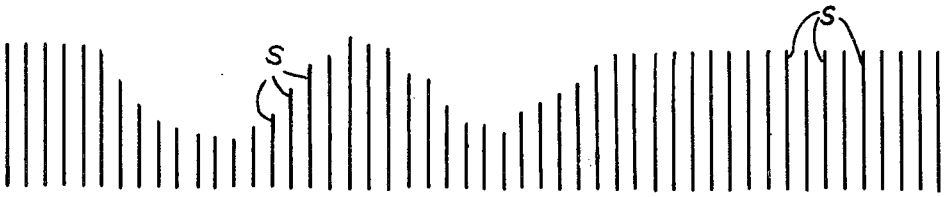
FIG. 5*b* is a plan view complementary to FIG. 5*a*, showing in linear development the sinkers illustrated in FIG. 5*a*.
Figure 7:
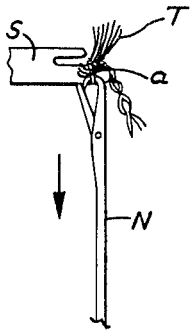
FIG. 7 is an enlarged, fragmentary view in elevation, looking in the direction of the arrows 7—7 in FIG. 5*a*, illustrating a needle at cast-off level.

FIGS. 5*a* and 5*b* show the coordination of the needles N and the sinkers S during knitting of fabric intermediate the angularly spaced doffers 12 and 13. As the needles N with the U-shaped tufts T of sliver fibers in their hooks are rotated past yarn tube 14, they start their descent to cast-off level, while the sinkers S are retracted from the needle circle. As the rotating needles descend to cast-off level, they take yarn a in their hooks. With the upwardly disposed tufts of fibers T and the yarn a in their hooks, the needles N reach cast-off level, as shown in FIG. 7, and then commence to rise to clear level, with the newly formed loops of sliver fibers and yarn still in their hooks. When the needles commence their ascent to clear level, the sinkers have been nearly fully advanced inwardly relative to the needle circle, between the needles N, to web holding position.

Figure 12:
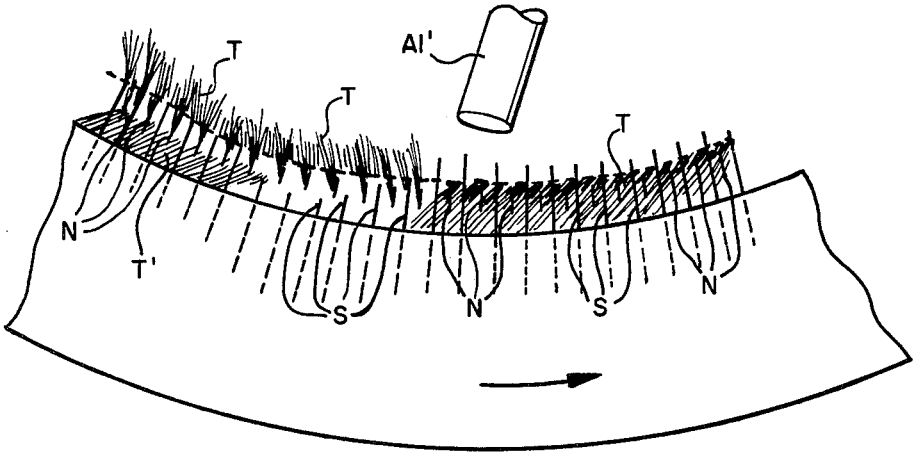
FIG. 12 is an enlarged, fragmentary, diagrammatic view in top plan illustrating schematically the manner in which the sinkers push the generally upstanding mass of sliver fibers about the needles, back into the needle circle, as the needles ascend from cast-off level.

Air jet A1' is disposed at a location, relative to the needle circle, where the needles begin their ascent to clear level. As the needles ascend, a jet of compressed air from the nozzle A1' blows the free ends of the tufts T of fibers outwardly of the needle circle, in the same direction between the needles N, as illustrated in FIG. 12, onto the tops of the sinkers. This action of the air jet A1' ultimately causes the free ends of the tufts of sliver fibers to traverse the sinker wales s1 in the knitted fabric, in the form of diagonal segments D and interlaced floats P, as illustrated in FIG. 2. The jet of compressed air blows not only the tufts of fibers T under the needle hooks outwardly of the needle circle, but also blows outwardly the free ends of the tufts T' anchored by the cleared stitches below the needle latches (FIGS. 6, 9) and the tufts anchored by one or more of the cast-off stitches immediately adjacent the needles, depending on the length of the sliver fibers. The result is to mingle the individual fibers of the several tufts extending outwardly of the needle circle to form an intermingled mass or web of entangled sliver fibers in sheet form.

The open end of the nozzle A1' is located to direct a stream of compressed air generally radially outward of the needle circle. For optimum results, the open end of the nozzle A1' may be disposed to direct the stream of compressed air slightly downward, rather than strictly horizontal, and slightly rearwardly in the direction of the oncoming rotating needles N. In such case, the free ends of the tufts of sliver fibers are blown around the needles to extend slightly diagonally, in the same direction, relative to both the sinkers and the needle latches, and are held by the compressed air to the tops of the sinkers at least until the ascending needles have begun to clear their latches. By directing the stream of compressed air slightly downward, the outwardly extending free ends of the fibers are retained on the tops of the sinkers as the needles begin to ascend to clear level.

Figure 9:
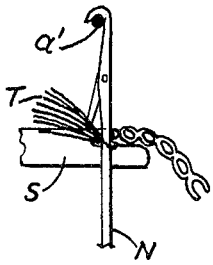
FIG. 9 is an enlarged, fragmentary view in elevation, looking in the direction of the arrows 9—9 in FIG. 5*a*, illustrating a needle which has risen to clear level, and is in the process of taking yarn in its hook.
Figure 11:
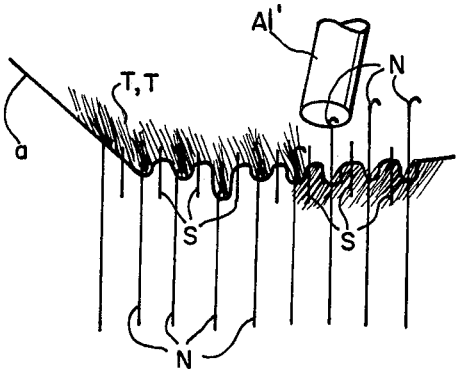
FIG. 11 is an enlarged, fragmentary view in linear development, similar to FIG. 10*a*, showing schematically in elevation the generally upstanding intermingled mass of diagonally oriented sliver fibers during the advance of the needles to and from cast-off level.

As the needles N rotate past the air jet A1', they continue their ascent to clear level, preparatory to taking yarn a' in their hooks. The sinkers S have advanced fully into the needle circle. As the needles ascend, their hooks pass through the outwardly extending sheet of fibers, and their open and cleared latches engage and retain most of the mingled fibers. The rotating needles N, after clearing, begin to descend to cast-off level once again, taking the yarn a' in their hooks, as illustrated in FIG. 9. As the needles descend to cast-off level, their latches are closed to trap the portion of the outwardly extending fibers retained thereon under the needle hooks. The diagonal disposition of the fibers relative to the needle latches facilitates this entrapment. The portion of the mingled free ends of the several tufts trapped under the needle hooks as the needles descend are formed into stitches with the yarn a', when the needles reach cast-off level. As a result, the trapped ends of the tufts are incorporated into the fabric, in the form of stitches, in a second course and a second wale of the fabric, as illustrated in FIG. 2. This stitch formation process brings the trapped fiber ends which had been blown to the outside of the needle circle back to the inside of the fabric sleeve in the form of knitted stitches to provide the loop pile effect. As the needles descend, their closing latches sweep the sheet of outwardly extending, diagonally inclined fibers, including the stray fibers, upwardly en mass into substantially vertical disposition, in the manner illustrated schematically in FIGS. 11 and 12.

The non-trapped or stray fiber ends are interlaced about the needles, below their latches, by the sinkers. Each time the sinkers S are advanced to web holding position, they engage and push the now generally upstanding sheet or mass of mingled, diagonally inclined fibers back into the needle circle in the manner illustrated schematically in FIG. 12. The result of this is to interlace the non-trapped stray fibers or "tailings" around the needles. As the sinkers advance, the forward ends or noses of their nibs strike the generally upstanding web of mingled fibers and commence pushing the fibers en mass inward relative to the circle of needles. As the sinkers continue to advance, the upper portions of their front profiles, i.e. their noses, the under edges of their nibs and their throats, push the fibers—both those trapped on the needle latches and the non-trapped stray fibers below the needle latches—around the needles into the needle circle as the needles ascend to clear level. Frictional engagement between the sides of the sinker nibs and the contiguous fibers also aids in urging the fibers into the needle circle.

As the needles N descend to cast-off level for the second time, the sinkers are retracted from the needle circle for a second time. After the needles N again reach cast-off level, they start their second ascent to clear level, and the sinkers S again advance inwardly of the needle circle.

The air jet A'1' is disposed at a position, relative to the needle circle, where the needles begin their next ascent to clear level. Its open end preferably is disposed, relative to the needles, in a manner identical to the disposition of the open end of the nozzle A1'. As the needles ascend, a jet of compressed air from the nozzle A'1' blows all of the free ends—both trapped ends and stray ends—of the several tufts of sliver fibers once again around the needles N and diagonally across the tops of the sinkers S outwardly of the needle circle, in the manner illustrated in FIG. 8. This action of the air jet A'1' ultimately causes the mingled free ends of the tufts to again traverse the sinker wales in the knitted fabric, e.g. sinker wales s2 as illustrated in FIG. 2.

As the needles N rotate past the air jet A'1', they continue their ascent to clear level. In the manner previously explained, the bulk of the diagonal, outwardly extending fibers are engaged and retained by the open latches of the ascending needles. Those fibers are trapped within the needle hooks when the latches again close, after the needles have taken fresh sliver fibers and a new yarn in their hooks and descend to cast-off level. The trapped fibers are formed into stitches with the new fibers and yarn, and are incorporated into the fabric in a third course and a third wale, as illustrated in FIG. 2.

The non-trapped or stray fibers extending outwardly of the needle circle again are pushed by the advancing sinkers back into the needle circle, below the needle latches in the manner previously explained, against the needles, preparatory to being incorporated into the fabric by interlacing. When the needles subsequently descend to cast-off level for the third time, the non-trapped fibers are cast over the needles and are incorporated into the fabric in the form of the interlaced portions or floats P. The compressed air from the nozzles A1' and A'1' in cooperation with the inward advances of the sinkers S causes the non-trapped fiber ends to be intertwined about the needles, and hence ultimately incorporated into the fabric in the form of the interlaced floats P.

Figure 8:
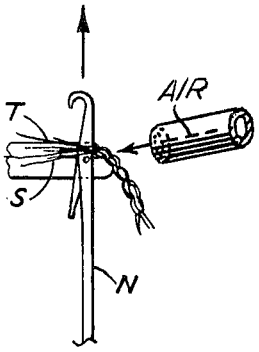
FIG. 8 is an enlarged, fragmentary view in elevation, looking in the direction of the arrows 8—8 in FIG. 5*a* illustrating a needle in the process of ascending from cast-off level.

Thus, the non-trapped or stray fibers, referred to herein as "tailings", are manipulated between and about the needles in the manner of an interlacement. Initially, the fibers are disposed in generally U-shaped configuration about the needles, with their free ends extending inwardly of the needle circle (FIGS. 6, 7). Thereupon, their free ends are blown around the needles and outwardly of the needle circle by the air jets (FIG. 8). Subsequently, the outwardly extending free ends of the non-trapped fibers, disposed diagonally relative to the needles as explained above, are urged inwardly to the needle circle by advancing sinkers, into contact with the needles. When the needles descend to cast-off level, those fibers are cast over the needles and incorporated into the fabric as the interlaced floats P. Next, the free ends of the non-trapped fibers again are blown around the needles and outwardly of the needle circle by the air jets, following which they are incorporated into the fabric either in the form of knitted stitches or in the form of the interlaced floats P.

Figure 4:
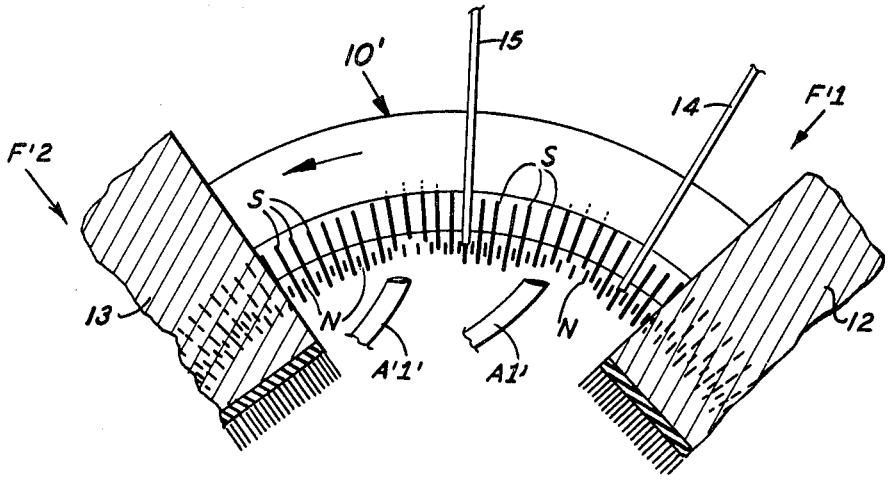
FIG. 4 is a fragmentary view in top plan showing schematically the knitting head of a modification of the FIG. 1 knitting machine of this invention, illustrating the machine components in more detail than FIG. 1.

With the modified knitting machine 10' illustrated in FIGS. 4–6, the needles N have cleared, and have the bulk of the free ends of the tufts T disposed diagonally on their open latches, as they rotate to the doffer 13, preparatory to taking fresh tufts of sliver fibers in their hooks. The stray ends or "tailings " are interlaced around the shanks of the needles below their latches. As the needles rotate past doffer 13, relative to feeding station F'2, they take fresh tufts of fibers and then a new yarn in their hooks, following which they again descend to cast-off level. At such time, the free ends of the tufts T, trapped in the needle hooks, are incorporated into the fabric together with the fresh tufts of sliver fibers and the new yarn.

The needle and sinker cams necessary for the above described operations of the needles N and sinkers S are a matter of common and general knowledge in the art. The selection of the camming to carry out the needle and sinker knitting manipulations to produce the fabric of FIG. 2 will be readily apparent to one skilled in the art, and a detailed description thereof is unnecessary.

Any type of conventional latch knitting needles may be employed, although it is preferred that needles having relatively long latches, on the order of 0.025 to 0.030 inches longer in length than normal, be utilized. A needle with a relatively long latch ensures that the latch will properly engage and retain the diagonal, outwardly extending fibers, as the needles ascend to clearing level, preparatory to trapping the fibers under the needle hooks as previously explained.

Various patterning effects may be produced in the fabric of FIG. 2 by selectively controlling or manipulating the air jets A1', A'1'. For example. the quantity, pressure or degree of compressed air emitted from the air jets may be selectively controlled, by selectively varying the size of the orifices of the air nozzles or by means of valves V of the type illustrated in FIG. 1, to produce various rib, corduroy, loop pile, etc. pattern effects. Variations in air volume and pressure at each air jet or nozzle, or continuous or intermittent air flow, may be controlled selectively by a programmed solenoid valve system. Additionally, the location or positioning of the open ends or orifices of the air jets A1', A'1' may be selectively varied relative to the sinkers, the needles, the cast-off positions of the needles, etc., thereby varying loop size to produce a variety of fabric patterning. The open ends of the air jets are disposed so as to direct the streams of compressed air generally radially outward of the needle circle. However, positioning the open ends of the air jets to direct their air streams slightly downwardly, and slightly rearwardly in the direction of the oncoming needles, helps ensure that the bulk of the outwardly extending fibers of each tuft T will be blown to one side of the needle on which they are retained, thus ensuring that the bulk of such fibers will traverse the sinker wales in the manner illustrated in FIGS. 2 and 3. Selective positioning, control or adjustments of the air jets permit variations in the size of the pile loops of the sliver fibers constituting the tufts T, as the free ends of the tufts are blown outwardly relative to the needle circle during knitting.

In the practice of this invention, a suction hoold (not shown) is disposed within the needle circle, to control fly loss of sliver fibers during the knitting. In the practice of this invention, for the purpose of controlling fly loss, and to improve the quality of the sliver loop knit fabrics made possible by the invention, the suction hood may be provided with radial extensions for overlying at least a portion of the cards delivering sliver fibers to the needles. Preferably, such radial extensions of the hood extend sufficiently far in the direction of the cards to cover or shield completely the doffers of each card.

Figure 10A:
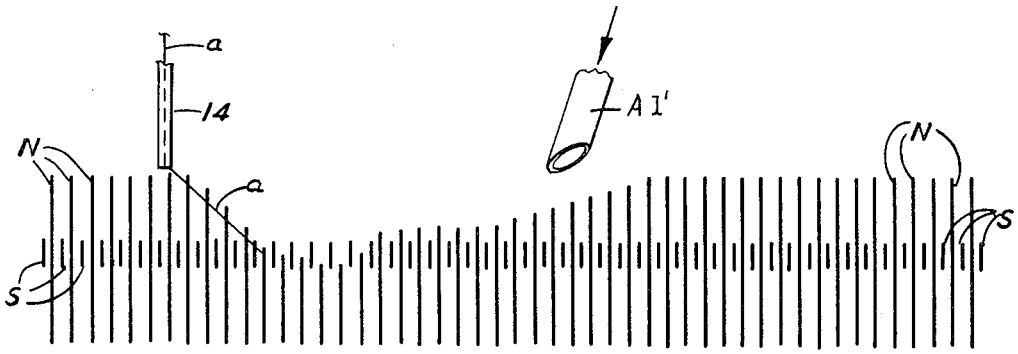
FIGS. 10*a* and 10*b* are linear developments similar to FIGS. 5*a* and 5*b*, respectively, showing the arrangement for knitting the fabric of FIG. 3.
Figure 10B:
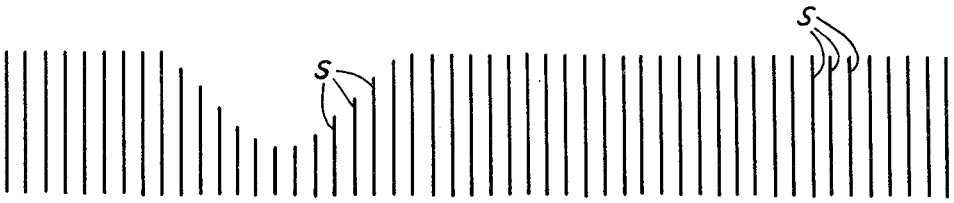

FIGS. 10*a* and 10*b* are views similar to FIGS. 5*a* and 5*b*, illustrating the arrangement for knitting the loop knit fabric of FIG. 3. In the arrangement of FIGS. 10*a*, 10*b*, the second yarn tube 15 and the second air jet A'1' are eliminated. In the arcuate space between the feeding stations F'1 and F'2, there is disposed a single yarn tube 14, feeding a yarn a to the needles N, and a single air jet A1'. In FIG. 10*a*, 10*a*, jet A1' is spaced somewhat further, in the direction of needle rotation, from the location on the needle circle where the needles descend to cast-off level than in FIG. 5*a*. As will be understood by those skilled in the art, the elimination of the intermediate yarn tubes and yarns, such as yarn tube 15 and yarn a', from the knitting arrangement shown in FIGS. 10*a*, 10*b*, eliminates the alternate yarn courses a', b', c', etc., from the fabric of FIG. 3.

The number of different courses and wales in which the staple fibers constituting the tufts T are incorporated in a sliver loop knit fabric of this invention may depend on the length of the discrete fibers forming the slivers. The greater the staple length of the sliver fibers, the greater the number of fabric courses and wales into which the fibers can be incorporated. For example, if relatively short sliver fibers are utilized for the knitting of the fabric of FIG. 3, the fibers constituting the tufts T1, T2, T3, T4 may be incorporated only in two courses and two wales of the fabric. If relatively long sliver fiber is utilized, the free ends of the tufts may be incorporated into three, four or more different courses and wales of the fabric.

As the needles rotate relative to the sliver and yarn feeding stations, passing successive air jets, the free ends of the tufts are repeatedly blown outwardly of the needle circle, until such free ends have been fully incorporated by knitting and interlacing into the fabric. The advance of the sinkers into the needle circle, each time the needles ascend from succeeding cast-off locations spaced around the needle circle, will continue to interlace the free ends of any stray fibers of the tufts about the needles, until all such fibers have been fully incorporated into the fabric. As will be understood, the selection of the length of sliver fibers utilized is a matter of choice, to be chosen according to the particular fabric pattern effect desired. Preferably, the bulk of the free ends of the sliver fibers are incorporated into the fabric in the form of knitted stitches, rather than by interlacing. The ratio quantity of fibers knit into the fabric, in comparison to those interlaced therein, is determined by the length of the latches of the needles N. The longer the latches, and the closer they extend, when open, to the tops of the sinkers, as illustrated in FIG. 9, the greater will be the quantity of fibers retained by the open latches and trapped within the needle hooks, when the latches close, preparatory to forming the fibers into knitted stitches in the fabric.

Although preferred embodiments of this invention have been shown and described for the purpose of illustration, as required by Title 35 U.S.C. 112, it is to be understood that various changes and modifications may be made therein without departing from the spirit and utility of the invention, or the scope thereof as set forth in the appended claims.

We claim:

1. A sliver loop knit fabric comprising a base fabric formed of knitted courses and knitted wales and a plurality of tufts of sliver fibers incorporated into the base fabric, wherein:

(a) each of the tufts of sliver fibers is incorporated into plural courses and plural wales of the base fabric to provide a loop pile texture on one side of the loop knit fabric and the appearance of a jersey knitted web on the opposite side thereof and (b) portions of each of the tufts are incorporated into the base fabric in the form of plural knitted stitches and other portions of the tufts are interlaced into the base fabric in the form of floats, (c) the plural knitted stitches formed from each of the tufts of sliver fibers being connected course-wise and wale-wise by diagonal segments of fibers, at least some of said floats being trapped between the base fabric and said diagonal segments of fibers, (d) said loop pile texture being constituted by said floats and by said diagonal segments of fibers.

2. The fabric of claim 1, wherein (a) the tufts comprise a plurality of groups of tufts, each group of tufts being composed of sliver fibers having a characteristic differing from the characteristics of the sliver fibers of which the other groups of tufts are composed and (b) the base fabric comprises a plurality of stitches each of which incorporates fibers from at least two different tufts of sliver fibers.

3. The fabric of claim 1, wherein (a) the sliver fibers comprise a plurality of groups of staple fibers of differing color and (b) the several groups of sliver fibers are incorporated into the base fabric to provide a multi-colored loop pile fabric.

* * * * *